US007201144B2

(12) United States Patent
Yuasa

(10) Patent No.: US 7,201,144 B2
(45) Date of Patent: Apr. 10, 2007

(54) OPERATING APPARATUS OF ENGINE IN PORTABLE WORKING MACHINE

(75) Inventor: Tsuneyoshi Yuasa, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/396,563

(22) Filed: Apr. 4, 2006

(65) Prior Publication Data

US 2006/0219218 A1 Oct. 5, 2006

(30) Foreign Application Priority Data

Apr. 5, 2005 (JP) ..... P2005-108703

(51) Int. Cl.
*F02D 11/04* (2006.01)
*F02D 17/04* (2006.01)

(52) U.S. Cl. ..... 123/400; 123/396

(58) Field of Classification Search ..... 123/397–398, 123/400, 396, 198 DB
See application file for complete search history.

(56) References Cited

U.S. PATENT DOCUMENTS 4,028,804 A * 6/1977 Hammond ..... 30/382
5,215,049 A * 6/1993 Wolf ..... 123/179.18
5,517,967 A * 5/1996 Nakayama ..... 123/398
5,685,271 A * 11/1997 Taomo et al. ..... 123/398
5,862,713 A * 1/1999 Tsunoda et al. ..... 74/526
6,006,627 A * 12/1999 Ikeda et al. ..... 74/531
6,021,630 A * 2/2000 Higashi et al. ..... 56/11.3
6,021,757 A * 2/2000 Nagashima ..... 123/400
6,363,911 B1 * 4/2002 Reinhardt et al. ..... 123/397
6,666,187 B2 * 12/2003 Dahlberg et al. ..... 123/398
6,823,591 B2 * 11/2004 Kobayashi et al. ..... 30/276
6,871,623 B2 * 3/2005 Ohsawa et al. ..... 123/179.18
7,000,593 B2 * 2/2006 Muller et al. ..... 123/398

FOREIGN PATENT DOCUMENTS

JP 57-52341 11/1982
JP 2001-159320 6/2001
JP 3237997 10/2001
JP 2002-303148 10/2002

* cited by examiner

*Primary Examiner*—Hai Huynh
(74) *Attorney, Agent, or Firm*—Wenderoth, Lind & Ponack, L.L.P.

(57) ABSTRACT

An operating apparatus of an engine in a portable working machine improves an operability of a throttle lever while preventing a Run-on phenomenon or the like. The operating apparatus is provided with a first operating device for operating a throttle valve of the engine in a range from a fully closed state to a fully opened state, a switch for switching the engine between an operable state and a stoppable state, and a second operating device for operating the switch. The second operating device is structured so as to regulate an operation position of the first operating device at a time of operating the switch such that the engine is brought into the operable state, and to allow the first operating device to fully close the throttle valve at a time of operating the switch such that the engine is brought into the stoppable state.

12 Claims, 9 Drawing Sheets

OPERATING APPARATUS OF ENGINE IN PORTABLE WORKING MACHINE

BACKGROUND OF THE INVENTION

1. Field of the Invention

The present invention relates to an operating apparatus of an engine in a portable working machine such as a blower, a bush cutter or the like.

2. Description of the Related Art

The portable working machine, for example, the blower is structured so as to spray a strong air flow to fallen leaves, dust or the like so as to collect them, and clean up. As shown in FIG. 1, the structure is made such that a worker carries an engine 8 and an air blower 11 on his or her shoulder so as to carry on the work while moving around. An injection pipe 12 is connected to a lead-out pipe 11A of the air blower 11 via a flexible pipe 13. A control handle 14 is provided in the injection pipe 12, and the worker controls the injection pipe 12 while gripping the control handle 14 (refer, for example, to Japanese Unexamined Patent Publication No. 2002-303, 148 (Publication 1)). The control handle 14 is normally provided with a throttle lever for operating a throttle valve of the engine 8, and a stop switch for electrically stopping the engine.

On the other hand, in Japanese Unexamined Patent Publication No. 2001-159,320 (Publication 2) and Japanese Utility Model Publication No. 57-52,341 (Publication 3), a technique is disclosed which relates to a throttle lever and an engine stop switch used in a control handle of a portable working machine. The technique is structured such that the control handle is provided with the throttle lever which operates a throttle valve of an engine of the portable working machine by remote control via a wire, a rotating speed of the engine is increased by rotating the throttle lever in one direction so as to increase a supply amount of an air-fuel mixture, and the rotating speed of the engine is reduced by rotating the throttle lever in the other direction so as to reduce the supply amount of the air-fuel mixture. The throttle lever has a stop switch built-in for electrically stopping the engine, and the stop switch is operated at a time of operating the throttle lever in a direction of reducing the rotating speed of the engine, thereby stopping the engine.

In Japanese Patent No. 3,237,997 (Publication 4), a technique is disclosed in which a control handle of a portable working machine is provided with a throttle lever, a throttle latch for regulating an operation of the throttle lever, and a throttle lock release lever for operating the throttle latch, a rotating speed of an engine of the portable working machine is increased and reduced by the throttle lever, and the throttle lever is held by the throttle latch at a predetermined position. The throttle lock release lever cancels the hold of the throttle lever by the throttle latch. Further, the control handle is provided with an engine stop switch operated by the throttle latch. The stop switch is operated in an engine stoppable state during which the throttle lever is held by the throttle latch, and is operated in an engine operable state during which the hold of the throttle lever by the throttle latch is released by the throttle rock release lever.

In this case, the work of the blower shown in FIG. 1 is executed as follows. First, the engine 8 is started, and the injection pipe 12 is directed to a working position while operating the throttle lever. The rotating speed of the engine 8 is increased and reduced by operating the throttle lever so as to be adjusted to an airflow amount in correspondence to the working state. Further, after finishing the work, the throttle lever is returned so as to set the engine 8 in an idling state, and then the engine stop switch is operated so as to stop the engine 8.

However, when the engine stop switch is operated, the engine 8 does not generally stop immediately, and rotates a little by an inertia force in the air blower 11 or the like. At this time, since the throttle valve is at an opening degree of an idling, the air-fuel mixture is sucked into a cylinder of the engine 8.

Further, a temperature of the engine 8 is increased during the work, and it is quite usual that the temperature is not reduced so much even at a time of operating the engine stop switch. Accordingly, the air-fuel mixture is sucked into the high-temperature cylinder, and is compressed by the rotation of the engine, so that the temperature of the air-fuel mixture is increased. Therefore, when the air-fuel mixture that is sucked into the cylinder reaches a certain air-fuel ratio and temperature, the air-fuel mixture is naturally ignited, and the rotation of the engine 8 is maintained (a Run-on phenomenon). On the other hand, in a working machine having a small rotational inertia force such as a bush cutter, unlike the blower, there is a case that a self ignition is not maintained, a rapid combustion is executed within a muffler, and a noise is generated (an after burn phenomenon).

In recent years, as an exhaust gas countermeasure, an engine executing the combustion on the basis of a lean air-fuel mixture is used for improving a specific fuel consumption or the like, and the temperature of the cylinder becomes higher. Therefore, a possibility that the Run-on phenomenon or the like is generated becomes higher.

As a method of preventing the Run-on phenomenon as mentioned above, there can be considered a method of completely closing the throttle valve at a time of operating the engine stop switch so as to completely shut off the suction of the air-fuel mixture.

The techniques disclosed in Publication 2 and 3 mentioned above are structured such that the engine stop switch is turned off at the same time of operating the throttle lever in the throttle valve closing direction. Accordingly, it is possible to turn off the stop switch in a state in which the suction of the air-fuel mixture is shut off by completely closing the throttle valve, and it is possible to prevent the Run-on phenomenon or the like.

However in this structure, since the rotational resistance is applied to the throttle lever by the spring and the throttle lever is held at a certain position by the resistance where a hand is released, an operating feeling is heavy. Further, since the throttle lever is held at an optimum operation position for the work on the basis of the resistance, once the throttle lever is moved from the position, it is necessary to readjust the throttle lever by the worker for again returning to the same position. Accordingly, the techniques disclosed in Publication 2 and 3 are deteriorated in the operability of the throttle lever.

On the other hand, the technique disclosed in Publication 4 can not prevent the Run-on phenomenon as mentioned above. In other words, since the throttle lever is held at the idling operation position by the throttle latch even if the throttle lock release lever is operated so as to stop the engine, there is a possibility that the air-fuel mixture is sucked into the cylinder of the engine. Further, the throttle latch only holds the throttle lever during the engine stop, and is not applied to the throttle lever during the engine operation. Accordingly, it is necessary to always grip the throttle lever so as to operate during the work.

SUMMARY OF THE INVENTION

The present invention addresses the above described condition, and an object of the present invention is to provide an operating apparatus of an engine in a portable working machine which can improve an operability of a throttle lever while preventing a Run-on phenomenon or the like.

In order to achieve the object mentioned above, in accordance with an aspect of the present invention, there is provided an operating apparatus of an engine having a throttle valve for regulating engine speed in a portable working machine comprising: a first operating device for operating the throttle valve of the engine in a range from a fully closed state to a fully opened state; a switch for switching the engine between an operable state and a stoppable state; and a second operating device for operating the switch; wherein the second operating device is structured so as to regulate an operation position of the first operating device at a time of operating the switch such that the engine is brought into the operable state, and to allow the first operating device to fully close the throttle valve at a time of operating the switch such that the engine is brought into the stoppable state.

In accordance with this structure, it is possible to operate the throttle valve of the engine by the first operating device during the work by the portable working machine, and it is possible to regulate the operation position of the first operating device at an optimum operation position for the work by the second operating device. When the work is finished, it is possible to stop the engine by operating the switch so as to bring the engine into stoppable state by the second operating device. At this time, since the position regulation of the first operating device by the second operating device is cancelled, and it is possible to operate the throttle valve to the fully closed state by the first operation device, it is possible to prevent an air-fuel mixture from being sucked into the cylinder. Accordingly, it is possible to prevent the run-on phenomenon and the after burn phenomenon. Since the second operating device is provided with both functions of operating the switch and regulating the operation position of the first operating device, it is possible to intend to simplify the structure.

Preferably, the second operating device may be structured so as to regulate an operation limit position of the first operating device in a throttle valve closing direction, to allow the first operating device to operate the throttle valve in a throttle valve opening direction from the operation limit position, and to optionally regulate the operation position of the first operating device at least between an operation position in which the throttle valve is fully opened and an operation position in which the engine is brought into an idling state, at a time of operating the switch so as to bring the engine into the operable state.

In accordance with this structure, it is possible to regulate the operation position of the first operating device to an optimum operation position in a working range (from an engine idling state to a throttle fully opened state) of the portable working machine by the second operating device. Even if the operation position of the first operating device is regulated by the second operating device, the first operating device is allowed to be operated in the throttle valve opening direction. Accordingly, it is possible to increase an output of the engine as demands of the operator, and it is possible to easily return the first operating device to the operation position regulated by the second operating device again. Therefore, an operability is improved.

Preferably, the operating apparatus may have a positioning means for positioning the second operating device at least at two positions, in which one of the two positions regulates the operation position of the first operating device to fully open the throttle valve, in which another of the two positions regulates the operation position of the first operating device to bring the engine into the idling state.

In accordance with this structure, it is possible to precisely position the second operating device, thereby it is possible to precisely regulate the operation position of the first operating device to the throttle fully opened operation position and the engine idling operation position.

Preferably, the first operating device may be energized in such a manner as to be returned to the throttle valve closing direction at a time when an operating force is not applied to the first operation device, and the second operating device may be structured so as to be capable of operating the throttle valve by operating the first operating device in an interlocking manner.

In accordance with this structure, it is possible to return the first operating device to the operation position regulated by the second operating device, by releasing a hand from the first operating device.

Preferably, the first operating device may have an engaging piece, and the second operating device may have an engaged piece which has a function of operating the switch and is engaged with the engaging piece so as to regulate the operation limit position of the first operating device in the throttle valve closing direction.

In accordance with this structure, since both of the position regulation of the first operating device and the operation of the switch are executed by the engaged piece, a simplification of the structure can be achieved.

Preferably, the engaged piece may be arranged so as to face to the throttle valve closing operation direction of the first operating device with respect to the engaging piece, the switch may be arranged in an opposite side to the engaging piece with respect to the engaged piece, and the engaged piece may be movable between the engaging piece and the switch on the basis of the operation of the second operating device.

In accordance with this structure, it is possible to change the regulating position of the first operating device and execute the operation of the switch, only by moving the engaged piece by means of the second operating device.

BRIEF DESCRIPTION OF THE DRAWINGS

This and other objects and features of the present invention will become clear from the following description taken in conjunction with a preferred embodiment thereof with reference to the accompanying drawings.

DETAILED DESCRIPTION OF THE PREFERRED EMBODIMENT

Figure 1:
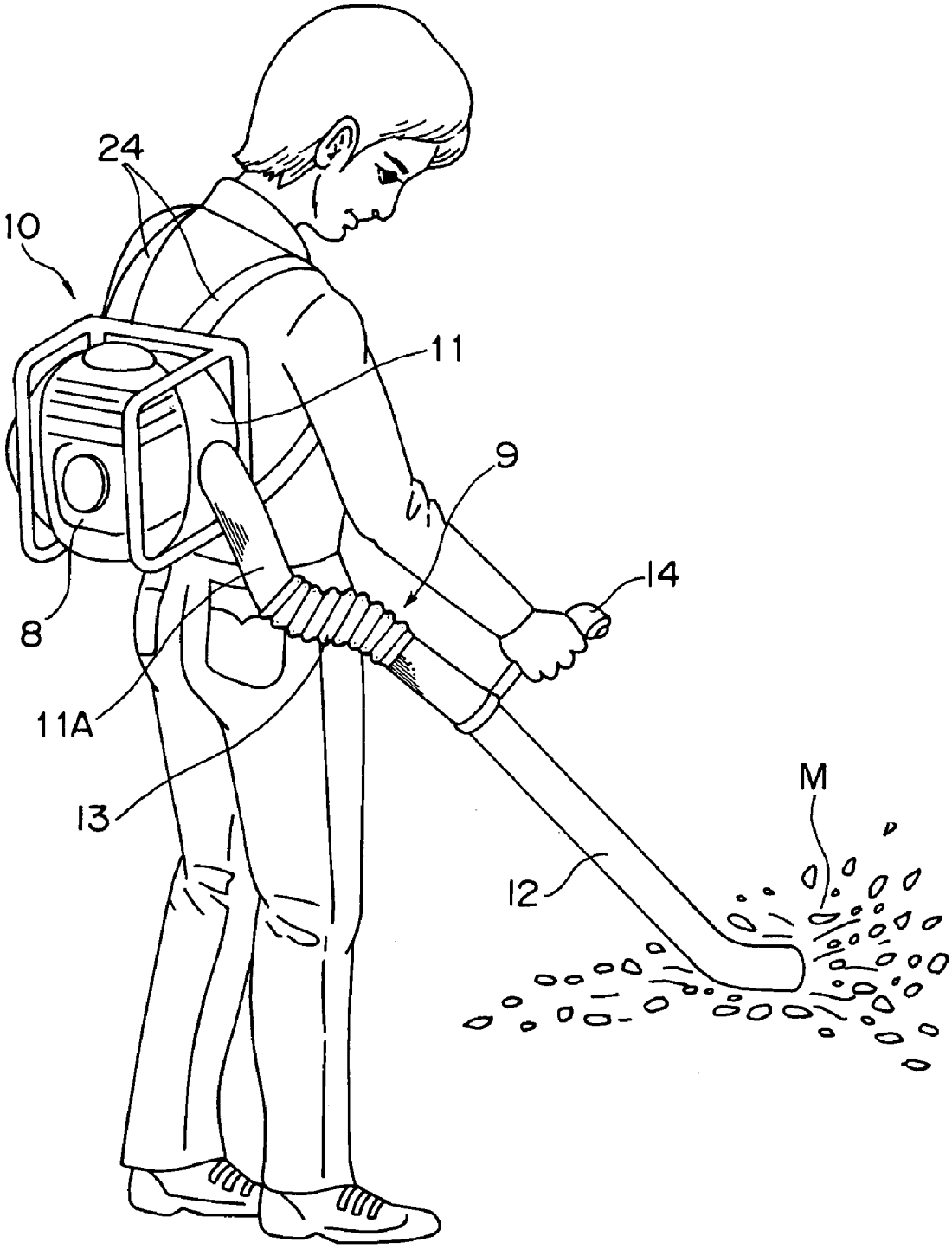
FIG. 1 is a perspective view showing a used state of a portable working machine.

FIG. 1 is a perspective view showing a used state of a portable working machine. The portable working machine in accordance with a present embodiment is constituted by a blower 10, and the blower 10 is provided with an engine 8, and a working apparatus 9 connected to the engine 8. The working apparatus 9 is provided with an air blower 11, and an injection pipe 12 connected to a lead-out pipe 11A of the air blower 11. The air blower 11 is driven by the engine 8 and blows out strong wind via the injection pipe 12. The engine 8 and the air blower 11 can be carried on the back of an operator via a pair of back bands 24. The injection pipe 12 is connected to the lead-out pipe 11A via a flexible pipe 13, and is structured so as to freely change a direction of a leading end thereof.

Figure 2:
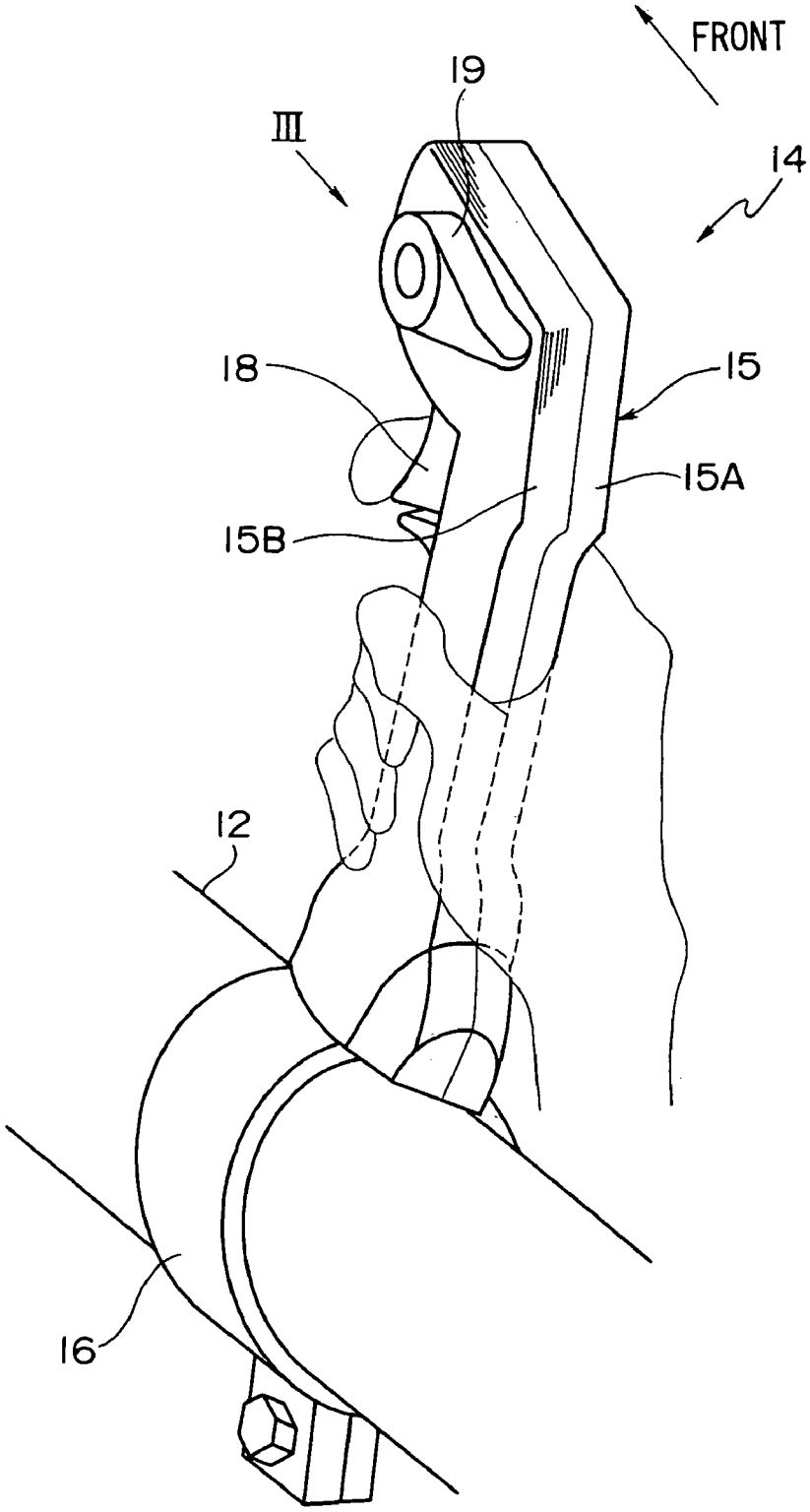
FIG. 2 is a perspective view showing a control handle of the portable working machine in FIG. 1.
Figure 3:
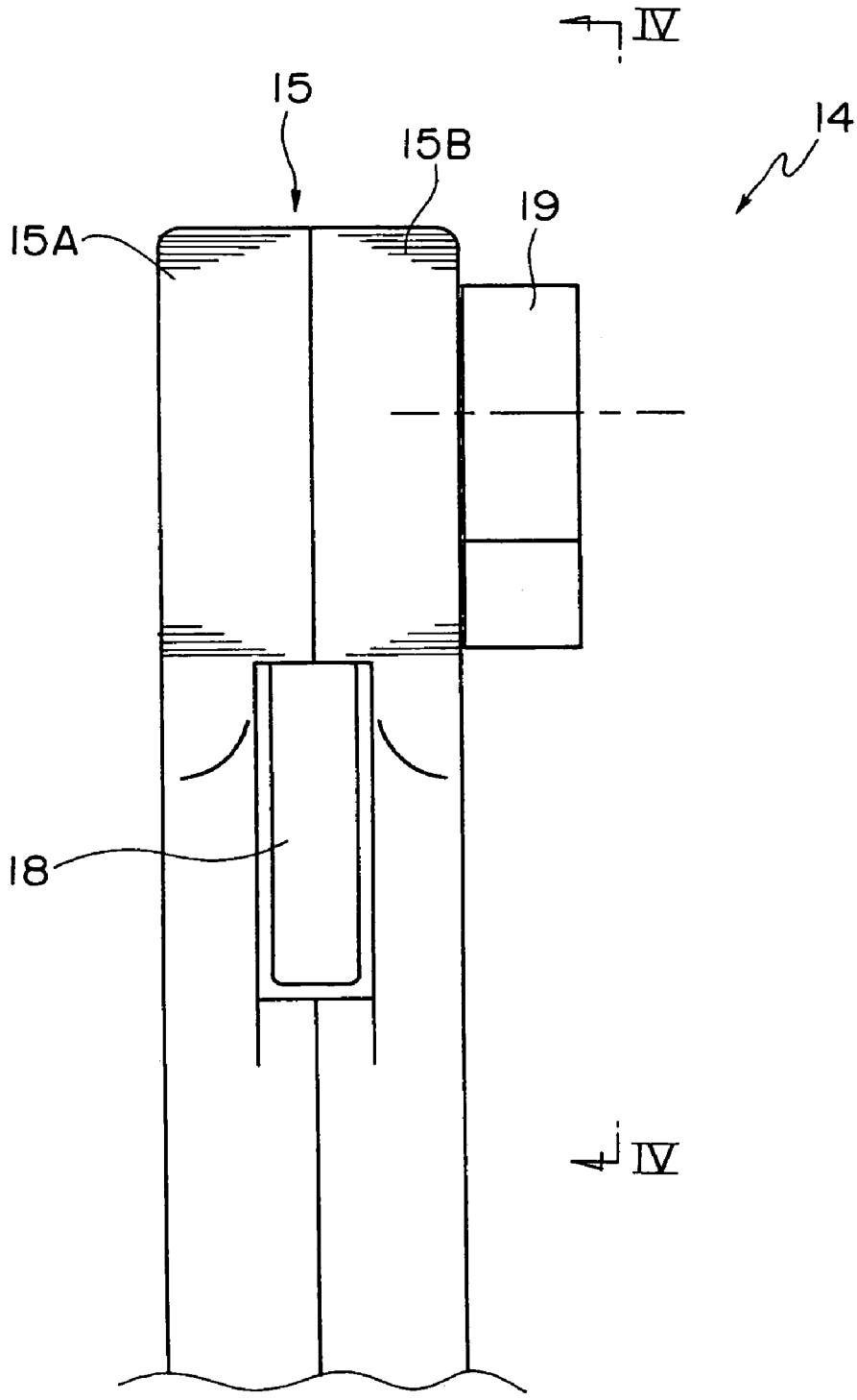
FIG. 3 is a view as seen from an arrow III in FIG. 2.

A control handle 14 is provided in a base end portion of the injection pipe 12 for the operator to grip and to manipulate the blower 11. FIG. 2 is a perspective view showing the control handle 14, and FIG. 3 is a view as seen from an arrow III in FIG. 2. The control handle 14 is provided with a handle main body 15, and a mounting device 16 for attaching the handle main body 15 to the injection pipe 12. The handle main body 15 is formed in an elongated rod shape so as to be gripped by one hand of the operator, and is structured by coupling a pair of approximately symmetrical divided bodies 15A and 15B to each other. The mounting device 16 is structured so as to surround an outer periphery of the injection pipe 12 and to be fastened to the injection pipe 12 by a bolt.

A throttle lever (a first operating device) 18 operating a throttle valve of the engine 8 (FIG. 1) to change engine speed is provided in a front face of an upper portion of the handle main body 15, and a regulating lever (a second operating device) 19 regulating an operation position of the throttle lever 18 is provided in a side surface of the upper portion of the handle main body 15. As shown in FIG. 2, when gripping the handle main body 15 by the one hand of the operator, the throttle lever 18 can be operated by a first finger of the operator, and the regulating lever 19 can be operated by a thumb of the operator. The regulating lever 19 may be operated by the other hand.

Figure 4:
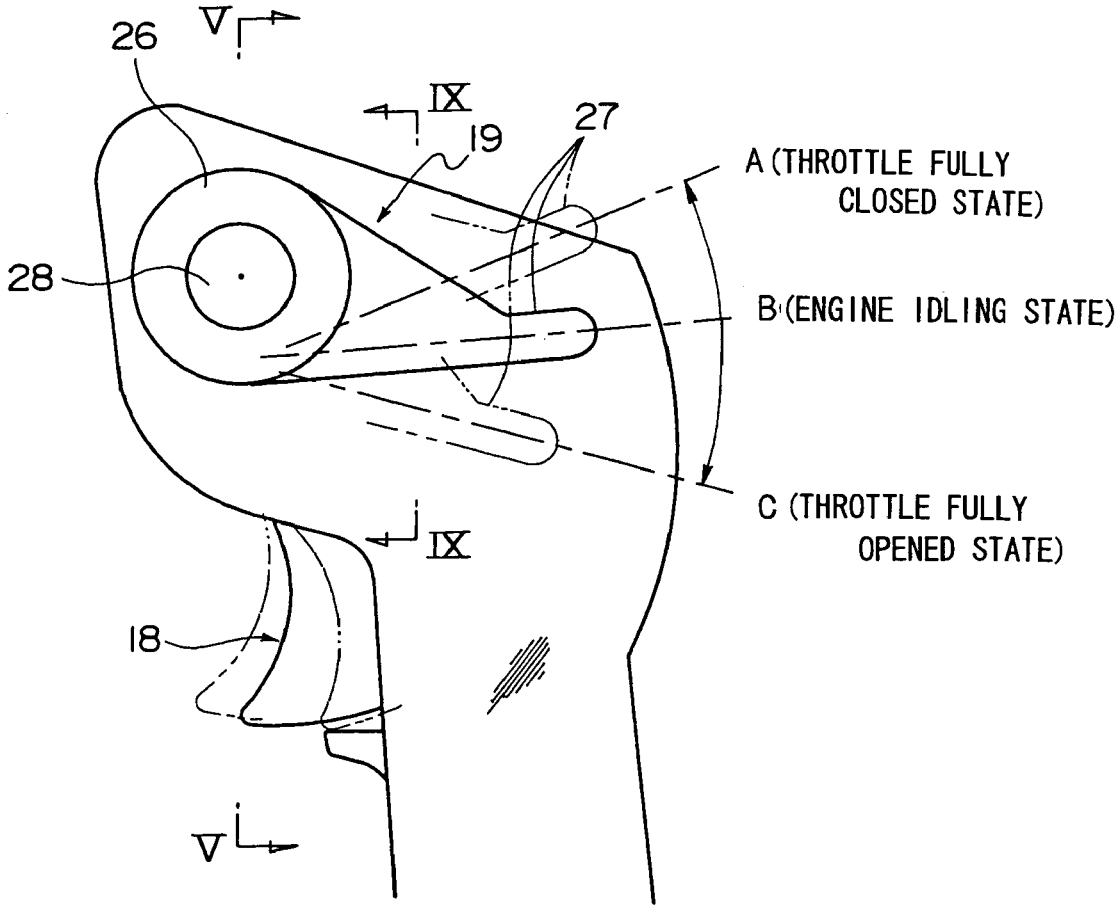
FIG. 4 is a view as seen from an arrow IV—IV in FIG. 2.
Figure 5:
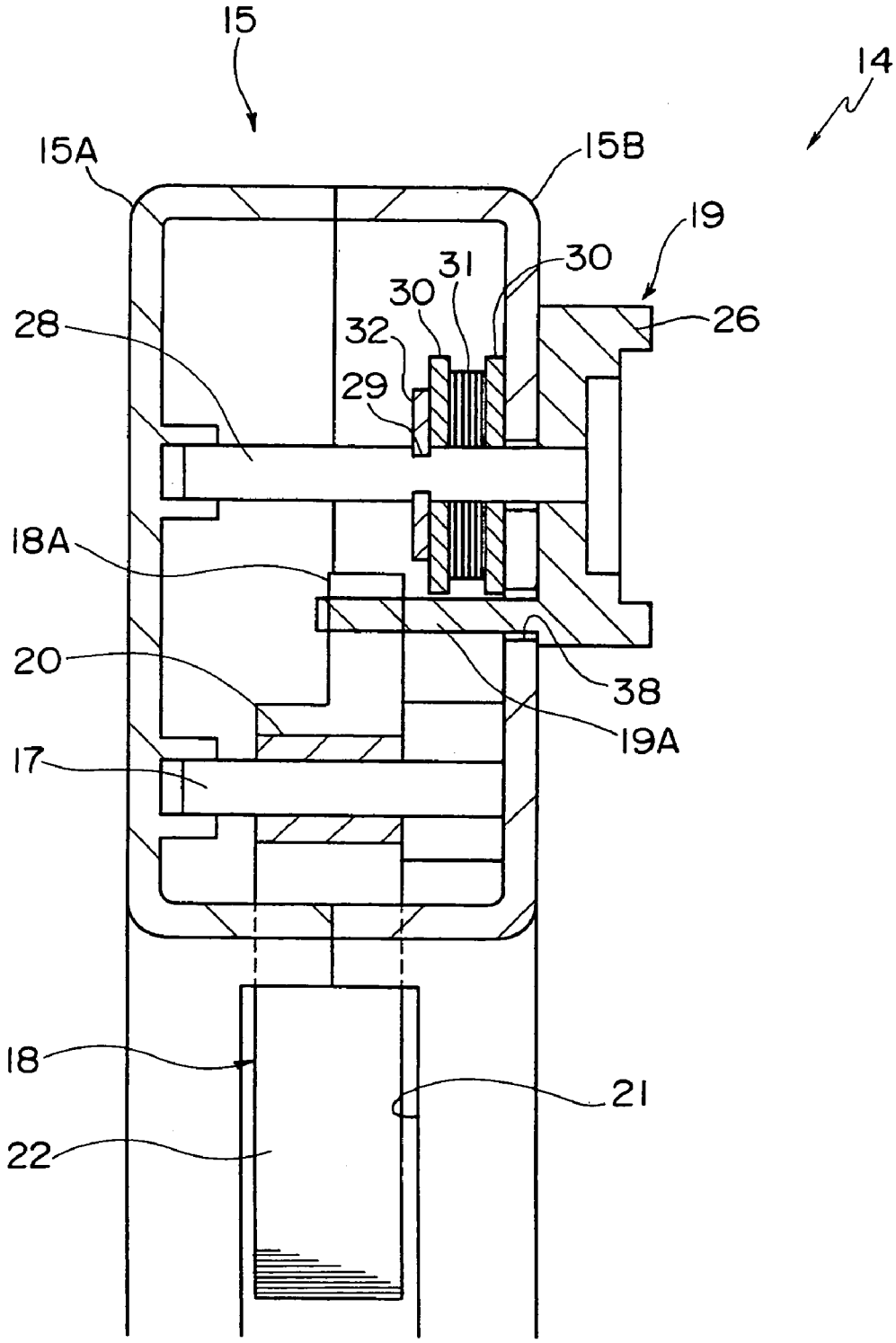
FIG. 5 is a cross sectional view as seen from an arrow V—V in FIG. 4.
Figure 6:
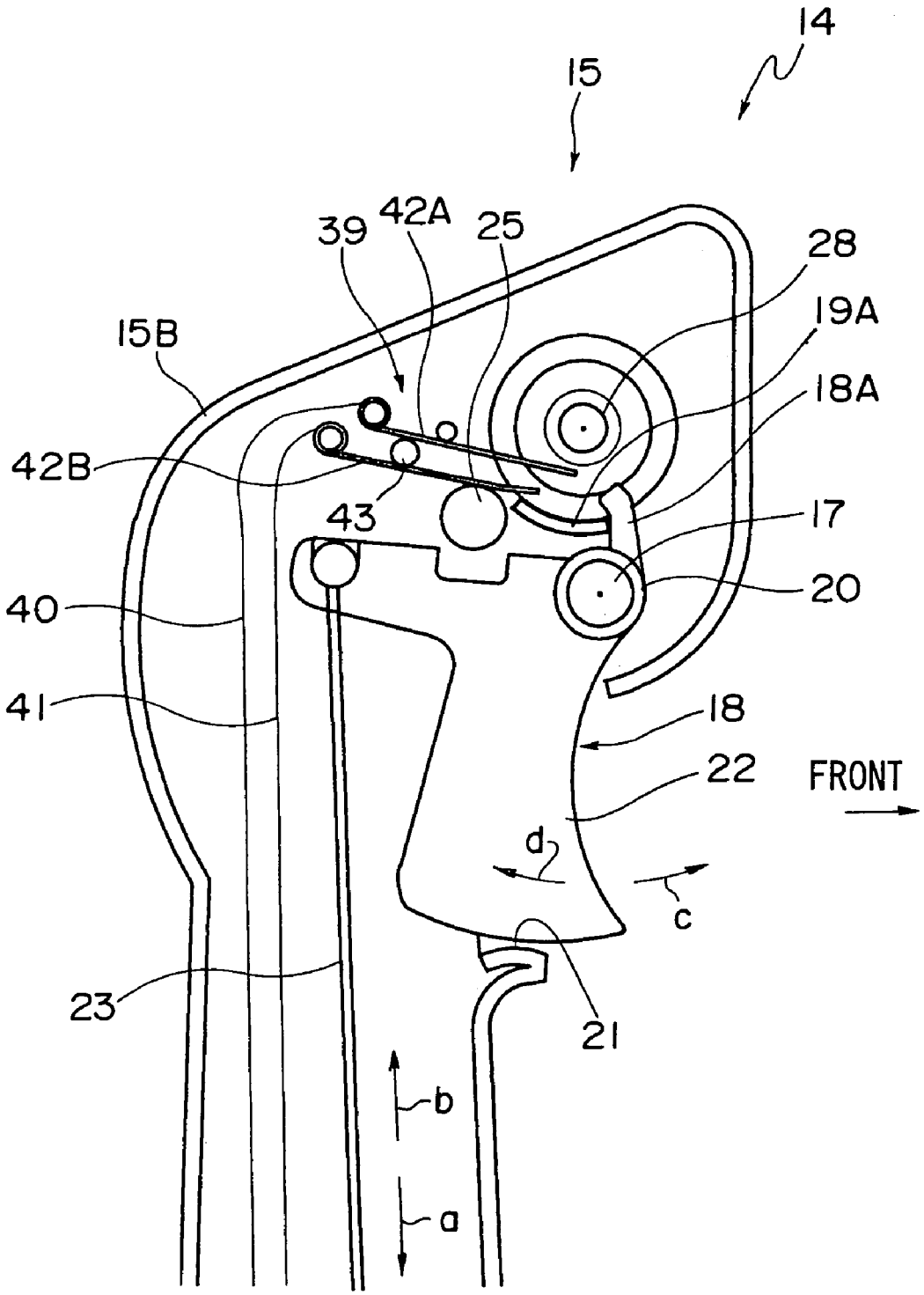
FIG. 6 is a side elevational view showing an inner portion of a handle main body.

FIG. 4 is a view as seen from an arrow IV—IV in FIG. 3, and FIG. 5 is a cross sectional view as seen from an arrow V—V in FIG. 4. FIG. 6 is a side elevational view showing an inner portion of the handle main body 15, and shows a state in which one divided body 15A of the handle main body 15 is removed. The throttle lever 18 is formed in an L shape in a side view, as shown in FIG. 6, and a pivot hole (not shown) formed at a corner boss portion 20 of the L-shaped throttle lever 18 is fitted rotatably to a lateral shaft 17 provided in the inner portion of the handle main body 15. One end portion of the L-shaped throttle lever 18 protrudes from an opening 21 formed in a front face of the handle main body 15. The protruding portion is structured as an operating portion operated by getting the finger caught therein. One end of a throttle wire 23 is engaged with the other end portion of the L-shaped throttle lever 18. The other end of the throttle wire 23 is coupled to the throttle valve of the engine 8. The throttle wire 23 reaches the engine 8 along the injection pipe 12, the flexible pipe and the like from the inner portion of the handle main body 15. An engaging piece 18A protruding to an upper side is provided in the corner boss portion 20 of the L-shaped throttle lever 18.

The throttle valve of the engine is operated by the throttle lever 18 in a range from a fully opened state to a fully closed state, and is structured so as to completely shut off a suction of an air-fuel mixture into a cylinder of the engine 8 at a time when the throttle valve is fully closed. In this embodiment, the throttle valve is energized in a closing direction of the throttle valve by a spring (not shown) or the like, and the throttle wire 23 is pulled in a direction of an arrow a in FIG. 6 on the basis of the energization. When the throttle lever 18 is pulled by the throttle wire 23, an energizing force in a direction of an arrow c is applied thereto.

When gripping the control handle 14 by the hand and operating the operating portion 22 of the throttle lever 18 in a direction of an arrow d by the first finger, the throttle valve is operated in an opening direction. When releasing the finger from the operating portion 22, the throttle lever 18 is rotated in the direction of the arrow c by the energizing force, and the throttle valve is operated in the closing direction. Reference numeral 25 in FIG. 6 denotes a stopper regulating an operation limit position of the throttle lever 18 in the opening direction.

As shown in FIG. 4, the regulating lever 19 is provided with a circular boss portion 26, and an operating portion 27 protruding in an outer side in a diametrical direction from the boss portion 26. A shaft pin 28 is inserted to a center of the boss portion 26 and fixed rigidly to the boss portion 26. The shaft pin 28 is inserted to the inner portion from a side surface of the handle main body 15 and supported rotatably by both side walls of the handle main body 15, as shown in FIG. 5. A groove 29 is formed in the middle of the shaft pin 28. A plane washer 30 and a wave washer 31 are installed between the groove 29 and one of the side walls of the handle main body 15, and a stop ring 32 executing a come-off prevention of the shaft pin 28 is installed in the groove 29 while deflecting the wave washer 31. The boss portion 26 is brought into pressure contact with the side surface of the handle main body 15 by the wave washer 31, and a rotational resistance is applied thereto. A coil spring or the like may be interposed between the washers 30 in place of the wave washer 31.

Figure 9:
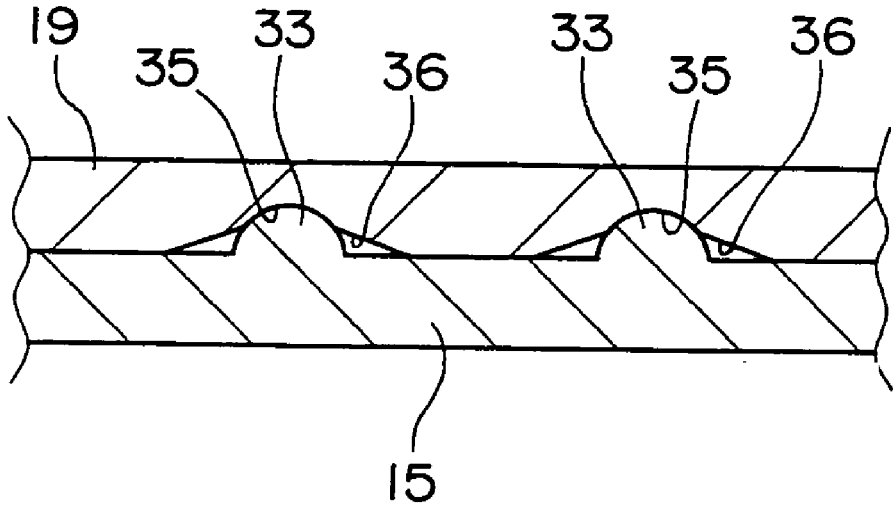
FIG. 9 is a cross sectional view as seen from an arrow IX—IX in FIG. 4.

As shown in FIG. 4, the regulating lever 19 is structured so as to be rotatable with the shaft pin 28 between a position where the operating portion 27 is oriented to a position A to a position where the operating portion 27 is oriented to a position C. FIG. 9 is a view as seen from an arrow IX—IX in FIG. 4, a plurality of semicircular projections 33 are formed in the side surface of the handle main body 15, and a plurality of concave portions 35 are formed in the regulating lever 19. The semicircular projection 33 and the concave portion 35 are engaged with each other at a time when the operating portion 27 is oriented to each of the positions A to C, and structure a positioning means (detent) for positioning the regulating lever 19 on the basis of the engagement. Further, the semicircular projection 33 and the concave portion 35 are engaged with each other so as to apply an operating feeling to the regulating lever 19, and can detect that the operating portion 27 exists at each of the positions A to C. A periphery of the concave portion 35 is formed as a smooth inclined surface 36, and makes it easy to detach the semicircular projection 33 from the concave portion 35.

As shown in FIGS. 5 and 6, an engaged piece 19A is provided in a protruding manner in the boss portion 26 of the regulating lever 19. The engaged piece 19A is formed in a circular arc plate shape around the shaft pin 28, and extends into the handle main body 15 in an axial direction of the shaft pin 28 via a slit 38 formed in the side wall of the handle main body 15. The engaged piece 19A is rotated together by rotating the regulating lever 19 with the shaft pin 28. Further, the engaged piece 19A is engaged with the engaging piece 18A of the throttle lever 18, thereby regulating the rotation of the throttle lever 18.

Figure 7:
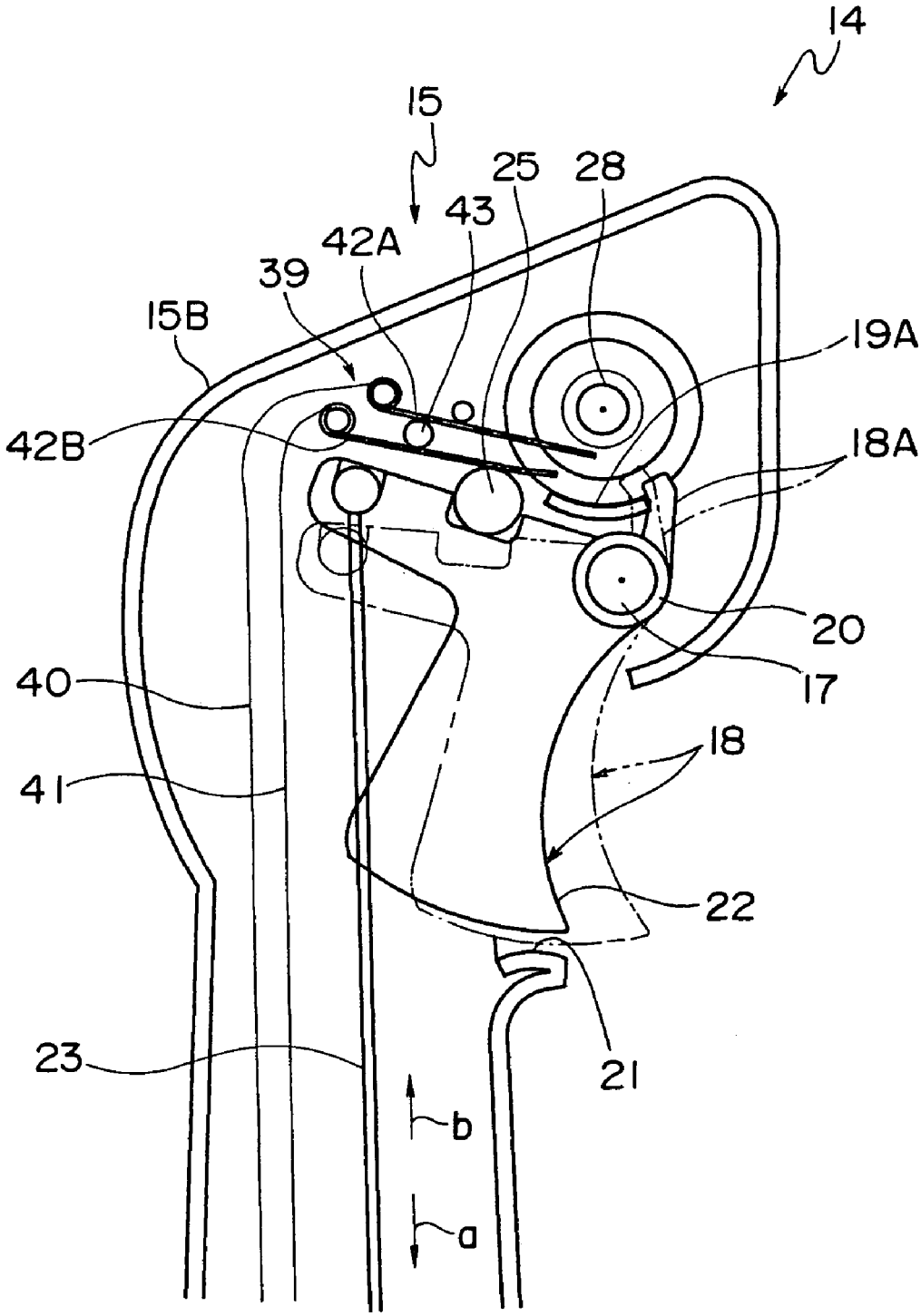
FIG. 7 is a side elevational view showing the inner portion of the handle main body of the control handle.
Figure 8:
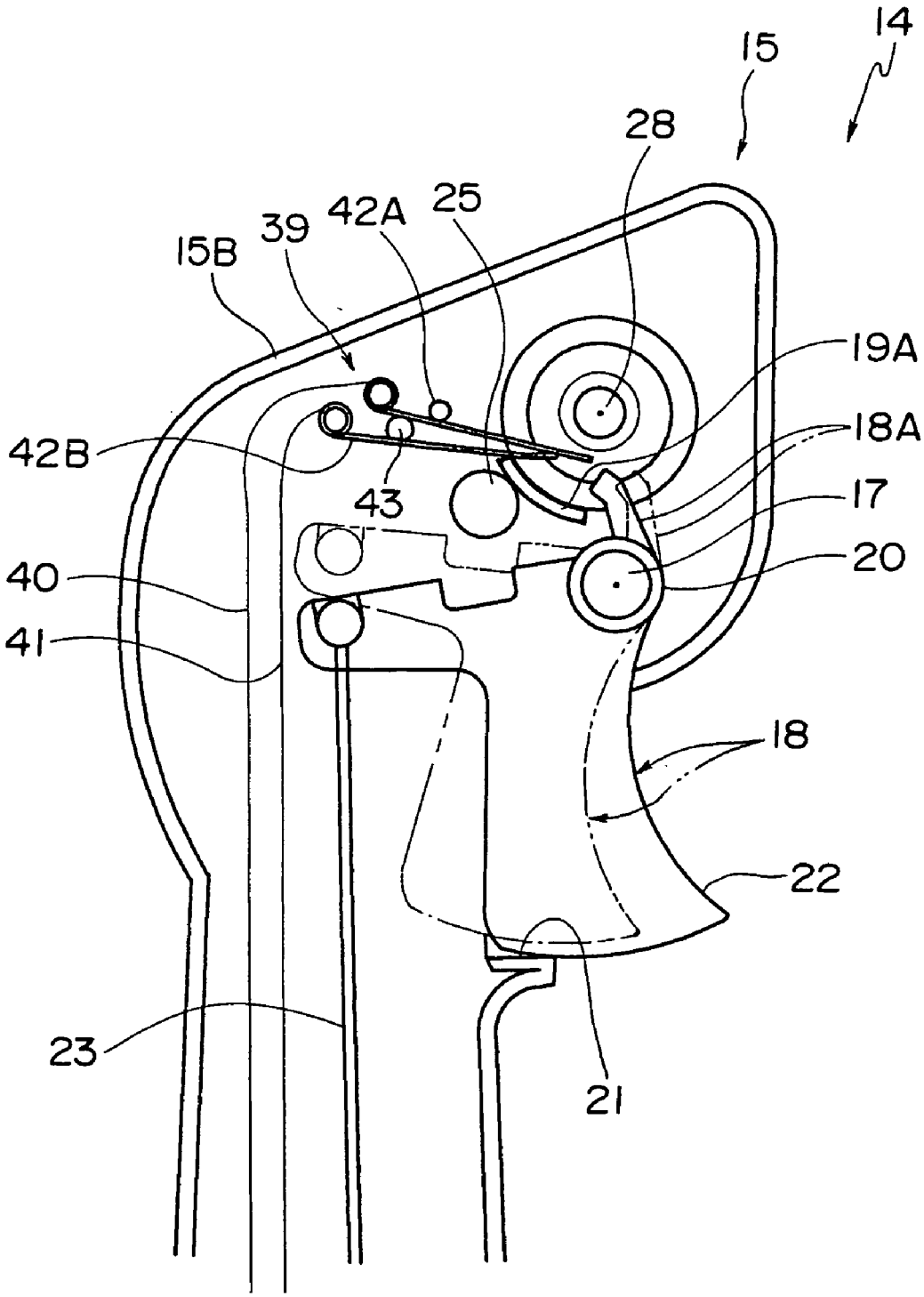
FIG. 8 is a side elevational view showing the inner portion of the handle main body.

FIGS. 7 and 8 are side elevational views showing the inner portion of the handle main body 15 in the same manner as FIG. 6. In particular, FIG. 6 shows a state in which the throttle lever 18 is regulated by the engaged piece 19A of the regulating lever 19 at a throttle idling operation position (an operation position in which the throttle valve is operated so as to bring the engine 8 into an idling state), and FIG. 7 shows a state in which the throttle lever 18 is regulated at a throttle fully opened operation position (an operation position in which the throttle valve is fully opened). FIG. 8 shows a state in which the throttle lever 18 is not regulated by the regulating lever 19 and exists at a throttle fully closed operation position (an operation position in which the throttle valve is fully closed).

When the operating portion 27 of the regulating lever 19 is oriented to the position B in FIG. 4, the engaged piece 19A exists at a position shown in FIG. 6. The engaging piece 18A of the throttle lever 18 is engaged with one end of the engaged piece 19A. In the throttle lever 18, the rotation in a direction of an arrow c, that is, the rotation in a direction of closing the throttle valve is regulated by the engaged piece 19A, and the throttle lever 18 operates the throttle valve in the engine idling state. Further, in the throttle lever 18, since the rotation in the direction of opening the throttle valve is not regulated, the throttle lever 18 can freely open the throttle valve.

When the operating portion 27 of the regulating lever 19 is oriented to the position C in FIG. 4, the engaged piece 19A exists at a position shown in FIG. 7. The engaging piece 18A of the throttle lever 18 is engaged with one end of the engaged piece 19A. The throttle lever 18 pulls the throttle wire 23 further from the throttle idling operation position shown by a two-dot chain line to the throttle fully opened operation position so that the throttle valve of the engine 8 is fully opened by the throttle wire 23, and is brought into contact with the stopper 25. Accordingly, the throttle lever 18 can be rotated neither in the throttle valve opening direction nor in the throttle valve closing direction any more, and is substantially fixed.

The engaged piece 19A of the regulating lever 19 is brought into contact with the engaging piece 18A so as to rotate the throttle lever 18 together at a time of moving from a state in FIG. 6 to a state in FIG. 7, thereby operating the throttle valve of the engine 8. In other words, the regulating lever can indirectly operate the throttle valve via the throttle lever 18.

When the operating portion 27 of the regulating lever 19 is oriented to the position A in FIG. 4, the engaged piece 19A exists at a position shown in FIG. 8. The engaging piece 18A of the throttle lever 18 is not engaged with the engaged piece 19A. Accordingly, the throttle valve can be operated by the throttle lever 18 in a range from the fully closed state to the fully opened state. In the case that the throttle lever 18 is not operated (in the case that the operating force is not applied to the throttle lever 18), the throttle valve is fully closed on the basis of the energizing force applied to the throttle valve by the spring (not shown) or the like. In this case, FIG. 8 shows the throttle lever 18 at the throttle fully closed operation position by a solid line, and shows the throttle lever 18 at the throttle idling operation position by a two-dot chain line.

As shown in FIG. 6, the control handle 14 is provided with a switch 39 switching the engine 8 to a operable state or a stoppable state. The switch 39 is arranged in the inner portion of the control handle 14 and in an opposite side to the engaging piece 18A with respect to the engaged piece 19A. The switch 39 is constituted by two plate members (metal switch pieces) 42A and 42B having a conductivity and one ends of which are supported to an inner side of the handle main body 15 via the shaft, and both the plate members 42A and 42B are arranged so as to face each other across a fixed gap. A primary line 40 of an ignition coil of the engine 8 is connected to the one plate member, and a ground line 41 is connected to the other plate member. Accordingly, the primary line 40 of the ignition coil is grounded by bringing both the plate members 42A and 42B into contact with each other, and the engine 8 is stopped. Further, both the plate members 42A and 42B are moved apart from each other, whereby the engine 8 becomes in an operable state (a movable state). The handle main body 15 is provided with a projection 43 holding the gap between both the plate members 42A and 42B.

The switch 39 is structured so as to be operated by the engaged piece 19A of the regulating lever 19. In other words, when the regulating lever 19 is operated at the position A in FIG. 4, and the engaged piece 19A is positioned as shown in FIG. 8, an end portion of the engaged piece 19A pushes the one plate member 42B so as to oscillate, and brings the one plate member 42B into contact with the other plate member 42A. Accordingly, the engine 8 is stopped. At this time, since the operation position of the throttle lever 18 is not regulated by the engaged piece 19A, the throttle lever 18 is arranged at the throttle fully closed operation position if the operating force is not applied.

A description will be given below of a case in which work such as cleaning or the like is executed by using the blower 10 in accordance with the present embodiment.

First, when starting the engine 8, the regulating lever 19 is positioned at the position B in FIG. 4. The throttle lever 18 is regulated to the throttle idling operation position by the engaged piece 19A, as shown in FIG. 6. The engaged piece 19A is not brought into contact with the switch 39, and both the plate members 42A and 42B of the switch 39 are apart from each other. Accordingly, the engine 8 is in the operable state.

It is possible to freely regulate the output of the engine 8 by operating the throttle lever 18 in the throttle valve opening direction (a direction of an arrow d in FIG. 6) after starting the engine 8. Accordingly, it is possible to freely regulate the air volume blowing out from the injection pipe (FIG. 1) so as to suitably blow out and collect the dust M or the like. Since the throttle lever 18 is energized in the throttle valve closing direction (a direction of an arrow c in FIG. 6), it is possible to lightly execute the operation only by applying the operating force in the throttle valve opening direction or loosening the operating force.

When stopping the operation of the throttle lever 18, the throttle lever 18 is returned in the throttle valve closing direction (the direction of the arrow c in FIG. 6) on the basis of the energizing force, and the engaging piece 18A is brought into contact with the engaged piece 19A, whereby the throttle lever 18 is regulated to the throttle idling operation position.

In the case that it is desired to keep the throttle lever 18 at a desired operation position and execute the work at a fixed engine output, the regulating lever 19 is rotated between the position B and the position C in FIG. 4. At this time, since the engaged piece 19A is engaged with the engaging piece 18A, for example, as shown in FIG. 7, the throttle lever 18 is rotated and the throttle valve is indirectly operated. If the rotation of the regulating lever 19 is stopped at a time when a desired engine output is achieved, the rotation of the throttle lever 18 is regulated at the position. Since the throttle lever 18 is operated in the interlocking manner by operating the regulating lever 19 and the throttle valve can be adjusted, it is not necessary to independently operate the regulating lever 19 and the throttle lever 18, and it is possible to easily operate.

In the case it is desired to temporarily increase the engine output after regulating the throttle lever 18 at the desired operation position, the throttle lever 18 is operated in the throttle valve opening direction. Further, in the case that it is desired to return to the original operation position, the throttle lever 18 is immediately returned to the position regulated by the engaged piece 19A on the basis of the energizing force, by releasing the hand from the throttle lever 18.

In the case that the work is finished and the engine 8 is stopped, the regulating lever 19 is rotated to the position A in FIG. 4 in a state in which the hand is released from the throttle lever 18. Accordingly, as shown in FIG. 8, the switch 39 is operated by the engaged piece 19A, and the engine 8 is stopped. At this time, the throttle lever 18 is returned to the throttle fully closed operation position on the basis of the energizing force. Accordingly, the suction of the air-fuel mixture into the cylinder is shut off, and the run-on phenomenon and the after burn phenomenon are prevented.

Since the regulating lever 19 has both the functions of regulating the position of the throttle lever 18 and operating the switch 39, it is possible to simplify the structure on the basis of the combination of the parts and reduce the cost. Further, as these functions are achieved only by the engaged piece 19A, it is possible to further simplify the structure.

The present invention can be carried out as follows.

(1) The switch 39 may be constituted by another type of on-off switch, such as a conventional engine stop switch, without being constituted by two plate members.

(2) The throttle lever 18 can be structured so as to be held at the operated positions thereof, by applying the rotational resistance with respect to the handle main body 15.

(3) The present invention can be applied to other portable working machines such as the a bush cutter and the like without being limited to the blower.

Although the invention has been described in its preferred embodiments with a certain degree of particularity, obviously many changes and variations are possible therein. It is therefore to be understood that the present invention may be practical otherwise than as specifically described herein with out departing from the scope and spirit thereof.

What is claimed is:

1. An operating apparatus of an engine having a throttle valve for regulating engine speed in a portable working machine, said operating apparatus comprising:

a first operating device for operating the throttle valve of the engine in a range from a fully closed state to a fully open state;

a switch for switching the engine between an operable state and a stoppable state;

and a second operating device for operating the switch;

wherein the second operating device is structured such that, when the engine is in the operable state, the second operating device is operable to set an operation limit position of the first operating device corresponding to a predetermined open position of the throttle valve, and to prevent the first operating device from moving from the operation limit position in a direction corresponding to a throttle valve closing direction, and wherein the second operating device is structured so as to allow the first operating device to fully close the throttle valve at a time of operating the switch such that the engine is brought into the stoppable state.

2. The operating apparatus of an engine in a portable working machine as claimed in claim 1, wherein the second operating device is structured such that, when the engine is in the operable state, the first operating device is movable from the operation limit position in a direction corresponding to a throttle valve opening direction so as to move the throttle valve in the throttle valve opening direction from the predetermined open position, and the second operating device is operable to selectively set the operation limit position of the first operating device in at least one position between an operation position in which the throttle valve is in the fully open state and an operation position in which the engine is brought into an idling state.

3. The operating apparatus of an engine in a portable working machine as claimed in claim 2, wherein the operating apparatus has a detent arrangement for holding the second operating device in one of at least at two positions, in which one of the at least two positions corresponds to an operation limit position of the first operating device in which the throttle valve is in the fully open state, and in which another of the at least two positions corresponds to an operation limit position of the first operating device in which the engine is brought into the idling state.

4. The operating apparatus of an engine in a portable working machine as claimed in claim 2, wherein the first operating device is energized in such a manner as to be returned to the operation limit position in the direction corresponding to the throttle valve closing direction when an operating force in the direction corresponding to the throttle valve opening direction is not applied to the first operation device.

5. The operating apparatus of an engine in a portable working machine as claimed in claim 4, wherein the first operating device has an engaging piece, and the second operating device has an engaged piece which operates the switch and is engaged with the engaging piece so as to prevent the first operating device from moving from the operation limit position in the direction corresponding to the throttle valve closing direction.

6. The operating apparatus of an engine in a portable working machine as claimed in claim 5, wherein the engaging piece is arranged at a side of the engaged piece facing the direction corresponding to the throttle valve closing direction, the switch is arranged at an opposite side of the engaged piece, and the engaged piece is movable between the engaging piece and the switch on the basis of the operation of the second operating device.

7. The operating apparatus of an engine in a portable working machine as claimed in claim 1, wherein the second operating device is structured such that, when the engine is in the operable state, the second operating device is operable to move the first operating device into the operation limit position.

8. The operating apparatus of an engine in a portable working machine as claimed in claim 7, wherein the second operating device is structured such that, when the engine is in the operable state, the first operating device is movable from the operation limit position in a direction corresponding to a throttle valve opening direction so as to move the throttle valve in the throttle valve opening direction from the predetermined open position, and the second operating device is operable to selectively set the operation limit position of the first operating device in at least one position between an operation position in which the throttle valve is in the fully open state and an operation position in which the engine is brought into an idling state.

9. The operating apparatus of an engine in a portable working machine as claimed in claim 8, wherein the operating apparatus has a detent arrangement for holding the second operating device in one of at least at two positions, in which one of the at least two positions corresponds to an operation limit position of the first operating device in which the throttle valve is in the fully open state, and in which another of the at least two positions corresponds to an operation limit position of the first operating device in which the engine is brought into the idling state.

10. The operating apparatus of an engine in a portable working machine as claimed in claim 8, wherein the first operating device is energized in such a manner as to be returned to the operation limit position in the direction corresponding to the throttle valve closing direction when an operating force in the direction corresponding to the throttle valve opening direction is not applied to the first operation device.

11. The operating apparatus of an engine in a portable working machine as claimed in claim 10, wherein the first operating device has an engaging piece, and the second operating device has an engaged piece which operates the switch and is engaged with the engaging piece so as to prevent the first operating device from moving from the operation limit position in the direction corresponding to the throttle valve closing direction.

12. The operating apparatus of an engine in a portable working machine as claimed in claim 11, wherein the engaging piece is arranged at a side of the engaged piece facing the direction corresponding to the throttle valve closing direction, the switch is arranged at an opposite side of the engaged piece, and the engaged piece is movable between the engaging piece and the switch on the basis of the operation of the second operating device.

* * * * *